United States Patent [19]

Kimotsuki

[11] 4,131,953

[45] Jan. 2, 1979

[54] VENTILATED HEAD GEAR

[75] Inventor: Kuninori Kimotsuki, Machida, Japan

[73] Assignee: Institute for Science of Labour, Kanagawa, Japan

[21] Appl. No.: 839,185

[22] Filed: Oct. 4, 1977

[30] Foreign Application Priority Data

Oct. 8, 1976 [JP] Japan ..... 51/135502[U]
Oct. 8, 1976 [JP] Japan ..... 51/135503[U]

[51] Int. Cl.[2] ..... A42B 1/20; A42B 1/18

[52] U.S. Cl. ..... 2/171.1; 2/182.6; 2/182.7; 2/184.5; 2/171.3

[58] Field of Search ..... 2/171.1, 182.1, 182.6, 2/182.7, 197, 171.3, 195, 175, 184.5, 171

[56] References Cited

U.S. PATENT DOCUMENTS

| | | | |
|---|---|---|---|
| 80,963 | 8/1868 | Johnson | 2/182.6 |
| 1,035,209 | 8/1912 | Matson | 2/171.1 |
| 1,885,745 | 11/1932 | Malcom | 2/182.6 |
| 2,127,797 | 8/1938 | Wittcoff | 2/182.6 |
| 3,780,382 | 12/1973 | Boden | 2/182.6 |

FOREIGN PATENT DOCUMENTS

| | | | |
|---|---|---|---|
| 1847 of | 1913 | United Kingdom | 2/182.7 |

*Primary Examiner*—Peter Nerbun
*Attorney, Agent, or Firm*—Hans Berman

[57] ABSTRACT

A ventilating cap essentially consisting of an inner frame and a shell having the shape of an inverted cup and dimensioned to envelop the frame. The frame includes a hat band extending in a closed loop about an axis and ribs attached to the band in circumferentially spaced relationship. The ribs extend from the band in a common axial direction and converge toward the axis. Respective portions of the ribs remote from the band and adjacent to the axis are fastened to each other. The rim portion of the shell is releasably fastened to the outer face of the head band in spaced relationship so as to define an annular ventilating gap, and an opening in the shell aligned with the fastened portions of the ribs may be obstructed at least in part by a larger disc releasably fastened to the ribs.

10 Claims, 5 Drawing Figures

VENTILATED HEAD GEAR

This invention relates to head gear, and particularly to head gear permitting access of air to the space about the head of the wearer covered by the head gear.

It is known to provide the crown of a hat or cap with small ventilating holes, but such holes restrict the flow of air to such an extent that they are of little benefit to workers or others engaged in vigorous physical activity outdoors and requiring protection against the sun.

It is an object of this invention to provide headgear which permits free flow of air through the space between the headgear and the head of the wearer. According to another object of the invention, the headgear may also be worn to protect the wearer's head against rain.

With these and other objects in view, the headgear of the invention includes a hat band extending in a closed loop about an axis and having inner and outer faces. Ribs attached to the band in circumferentially spaced relationship extend from the band in a common axial direction and converge toward the axis. Respective portions of the ribs remote from the band and adjacent to the axis are fastened to each other. The headgear further includes a shell dimensioned to envelop the band and the ribs. It has the approximate shape of a cup including an annular rim portion bounding an open side of the shell and a bottom wall formed with an opening therein. The rim portion of the cap may be fastened releasably to the outer face of the hat band in a position in which the rim portion and the outer face of the band define therebetween a ventilating gap, and the opening is axially aligned with the fastened portions of the ribs. A disc larger than the opening may be secured releasably to the afore-mentioned portions of the ribs to obstruct the opening at least partly.

Other features, additional objects, and many of the attendant advantages of this invention will readily be appreciated as the same becomes better understood by reference to the following detailed description of preferred embodiments when considered in connection with the appended drawing in which.

Figure 1:
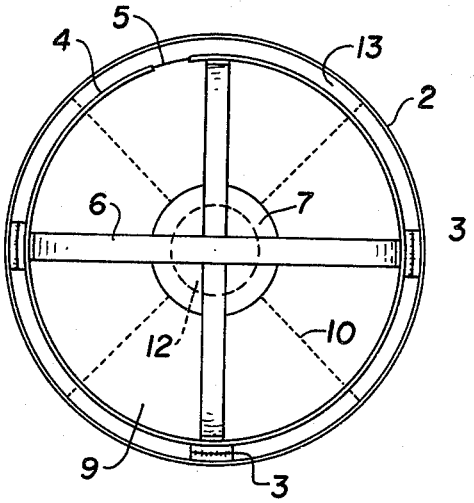
FIG. 1 shows a cap according to this invention in bottom plan view.
Figure 2:
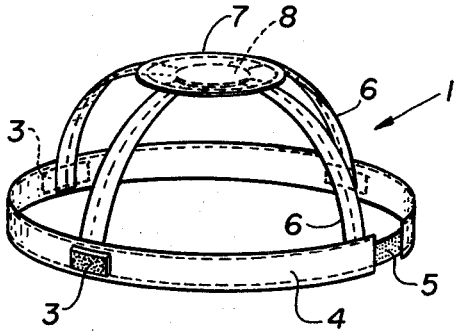
FIG. 2 is a perspective view of an inner frame in the cap of FIG. 1.
Figure 3:
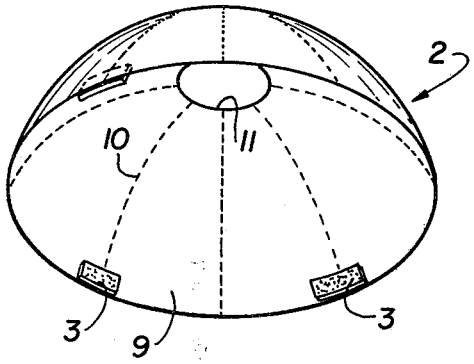
FIG. 3 shows the shell of the cap of FIG. 1 in a perspective view.

The cap illustrated in FIGS. 1 to 3 consists of a frame 1 and an approximately hemi-spherical shell 2 attached to each other by three pairs of Velcro strips 3, the strips of each pair being spaced circumferentially on the outer face of a hat band 4 and on the inner face of the rim about the open side of the shell 2. Velcro is a registered trademark for fasteners consisting of a base from which closely spaced hooks of nylon filament project. The hooks of two Velcro strips readily engage each other to connect elements respectively attached to the strips, but may be peeled apart by suitably applied manual tension.

The hat band 4 is a strap of thin leather or plastic whose longitudinal ends are connected in a closed loop by a piece 5 of elastic fabric. The two ends of each of two canvas bands 6 are attached to respective parts of the hat band 4 spaced about 90° apart about the axis of the loop, and the bands 6 are long enough to extend in a common axial direction from the band 4 in respective, approximately semi-circular arcs, the apex of one arc being sewn to the other apex. The bands 6 thus constitute four ribs of the frame 1 which converge toward the axis of the frame, and whose portions adjacent the axis are fixedly connected. A disc 7 of pliable fabric is attached to the connected rib portions by yet another pair 8 of Velcro strips.

The shell 2 is assembled from fabric segments 9 attached to each other along seams 10 which stiffen the shell to make it shape-retaining and converge from the rim of the shell 2 toward a central opening 11 in the bottom wall of the inverted cup shape of the shell. The opening is smaller than the disc 7 but large enough to define axial air passages 12 with the bands 6 when the cap 2 is attached to the frame 1 in the absence of the disc 7, as is best seen in FIG. 1.

The bases of the Velcro strips 3 are thick enough to make the combined thickness of each engaged pair of strips somewhat greater than 5 millimeters. The strips 3 thus function as spacers which define an annular gap 13 between the head band 4 and the rim of the shell 2. The fairly rigid shell 2 is dimensioned spacedly to envelop the frame 1. Air may enter a space surrounding the head of the wearer in the shell 2 through the gap 13, rise along the inner face of the shell and escape through the central opening 11 which cannot be obstructed by the bands 6 even if the top of the shell should become seated on the connected band portions. The body heat of the wearer provides the energy for the thermal syphon causing air movement.

In the event of rain, the pliable disc 7 is introduced between the shell 2 and the frame 1 through the opening 11 and attached to the bands 6 by the Velcro strips 8. It prevents the entry of significant amounts of rain water, but does not prevent air flow through the opening 11 if the shell 2 is stiff enough to maintain a gap around the circumference of the disc 7.

Figure 4:
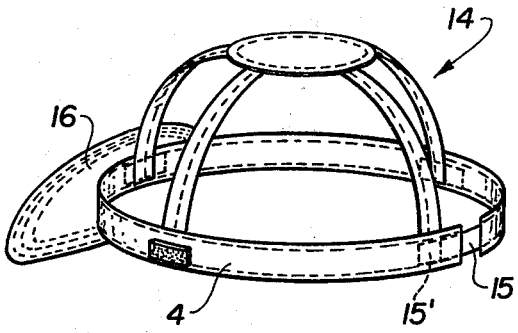
FIG. 4 illustrates a modified frame for use with the shell of FIG. 3 in a perspective view.
Figure 5:
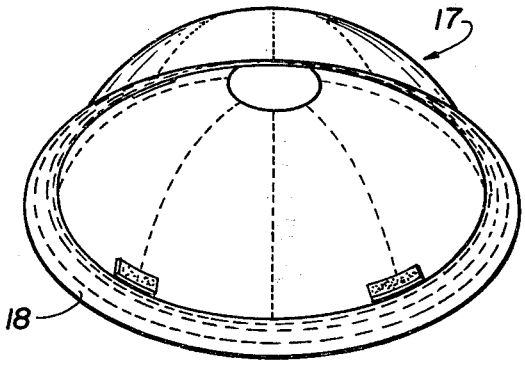
FIG. 5 is a perspective view of a modified shell for use with the frame of FIG. 2.

The cap shown in FIGS. 1 to 3 is capable of many modifications without change in its basic mode of operation. The frame and shell may have a shape other than the hemi-spherical configuration illustrated. The adjustability of the head band 4 to the circumference of the wearer's head may be achieved by means other than the elastic piece of fabric 5, and fasteners other than the preferred Velcro strips may be employed for releasably fastening the shell 2 to the hat band 4, and for attaching the disc 7 to the connected portions of the bands 6. Snap fasteners may be used in a known manner and engaged by pressure applied thereto in opposite directions. FIGS. 4 and 5 are illustrative of some such modifications, and others will readily suggest themselves.

The frame 14 illustrated in FIG. 4 differs from that shown in FIGS. 1 and 2 by Velcro strips 15,15' attached to the two ends of the hat band 4 in such a manner as to permit stepless variation in the length of the loop mainly formed by the hat band 4. A stiff visor 16 attached to the hat band 4 projects radially beyond the shell when the shell 2 shown in FIG. 3 is placed over the frame 14 in a manner evident from FIG. 1. However, the frame 14 may also be worn without the shell.

The shell 17 illustrated in FIG. 5 differs from that seen in FIG. 3 by an annular brim 18 attached to the rim of a hemi-spherical shell portion in angularly offset relationship and projecting from the rim in a radially outward direction.

It should be understood, of course, that the foregoing disclosure relates only to preferred embodiments, and that it is intended to cover all changes and modifications of the examples of the invention herein chosen for the purpose of the disclosure which do not constitute departures from the spirit and scope of the invention set forth in the appended claims.

What is claimed is:

1. Headwear comprising:

(a) a hat band extending in a closed loop about an axis and having an inner face and an outer face;

(b) a plurality of rib members attached to said band in circumferentially spaced relationship, (1) said rib members extending from said band in a common axial direction and converging toward said axis, (2) respective portions of said rib members remote from said band and adjacent said axis being fastened to each other;

(c) a shell dimensioned spacedly to envelop said band and said rib members, (1) said shell having the approximate shape of a cup and including an annular rim portion bounding an open side of said shell and a bottom wall formed with an opening therein;

(d) fastening means on said rim portion for releasably fastening the same to the outer face of said hat band in a position in which said rim portion and said outer face define therebetween a ventilating gap and said opening is axially aligned with said portions of the rib members;

(e) a disc member larger than said opening; and (f) securing means for releasably securing said disc member to said portions of the rib members.

2. Headgear as set forth in claim 1, wherein said shell is shape-retaining and approximately hemispherical.

3. Headgear as set forth in claim 1, further comprising adjusting means on said band for varying the length of said loop.

4. Headgear as set forth in claim 3, wherein said band includes an elongated piece of material and said adjusting means include means for releasably attaching the longitudinally terminal portions of said band to each other in a plurality of longitudinally offset relative positions.

5. Headgear as set forth in claim 3, wherein a portion of said band is resiliently expandable and constitutes said adjusting means.

6. Headgear as set forth in claim 1, wherein said fastening means include a plurality of spacer elements circumferentially distributed about said loop between said band and said rim portion and defining a width of said gap of at least 5 millimeters.

7. Headgear as set forth in claim 6, wherein said gap is annular.

8. Headgear as set forth in claim 1, further comprising a visor mounted on said hat band and projecting therefrom away from said axis over less than one half of said loop.

9. Headgear as set forth in claim 1, further including an annular brim attached to said rim portion in angularly offset relationship and extending from said rim portion in a direction away from said axis.

10. Headgear as set forth in claim 1, wherein said securing means including respective engagement elements on said disc member and on said portions of the rib members, said elements being capable of being engaged by pressure applied thereto in respective opposite directions, and of being disengaged by tension respectively applied thereto in opposite direction.

* * * * *